US009327152B2

(12) United States Patent
Dolton

(10) Patent No.: US 9,327,152 B2
(45) Date of Patent: May 3, 2016

(54) CLOTHES DRYER FIRE EXTINGUISHER SYSTEM

(71) Applicant: Edward Dolton, Brick, NJ (US)

(72) Inventor: Edward Dolton, Brick, NJ (US)

( * ) Notice: Subject to any disclaimer, the term of this patent is extended or adjusted under 35 U.S.C. 154(b) by 586 days.

(21) Appl. No.: 13/681,620

(22) Filed: Nov. 20, 2012

(65) Prior Publication Data

US 2014/0138106 A1 May 22, 2014

(51) Int. Cl.

| | |
|---|---|
| ***A62C 3/00*** | (2006.01) |
| ***A62C 35/10*** | (2006.01) |
| ***A62C 37/36*** | (2006.01) |
| ***A62C 3/02*** | (2006.01) |
| ***A62C 37/00*** | (2006.01) |
| ***A62C 37/10*** | (2006.01) |
| ***A62C 37/08*** | (2006.01) |
| ***D06F 58/28*** | (2006.01) |
| ***A62C 3/16*** | (2006.01) |
| ***D06F 58/20*** | (2006.01) |

(52) U.S. Cl.

CPC . *A62C 35/10* (2013.01); *A62C 3/00* (2013.01); *A62C 3/006* (2013.01); *A62C 3/02* (2013.01); *A62C 3/16* (2013.01); *A62C 37/00* (2013.01); *A62C 37/08* (2013.01); *A62C 37/10* (2013.01); *A62C 37/36* (2013.01); *D06F 58/20* (2013.01); *D06F 58/28* (2013.01); *D06F 2058/2858* (2013.01)

(58) Field of Classification Search

CPC ..... A62C 3/00; A62C 3/37; A62C 3/36; A62C 3/02; A62C 3/006; A62C 37/00; A62C 37/08; A62C 37/10; A62C 37/36; A62C 35/10; A62C 3/16; D06F 58/28; D06F 2058/2887; D06F 2058/2858; D06F 58/20

USPC ..... 169/26, 37, 56, 60, 65, 70; 34/544

See application file for complete search history.

(56) References Cited

U.S. PATENT DOCUMENTS

| | | | | |
|---|---|---|---|---|
| 2,664,955 | A * | 1/1954 | Winkler | A62C 99/009 169/26 |
| 3,283,827 | A * | 11/1966 | Diehl | 169/65 |
| 4,524,835 | A * | 6/1985 | Mingrone | 169/65 |
| 5,396,715 | A * | 3/1995 | Smith | 34/544 |
| 6,655,047 | B2 * | 12/2003 | Miller, II | 34/544 |
| 2010/0175898 | A1 * | 7/2010 | Steinicke | 34/544 |

* cited by examiner

*Primary Examiner* — Steven J Ganey

(74) *Attorney, Agent, or Firm* — Myers Wolin, LLC

(57) ABSTRACT

A fire extinguisher system comprising a conduit and at least one storage, with at least one valve connected to the at least one storage responsive to a heat event within the conduit.

18 Claims, 4 Drawing Sheets

FIG. 1A
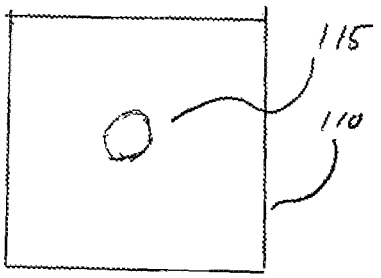
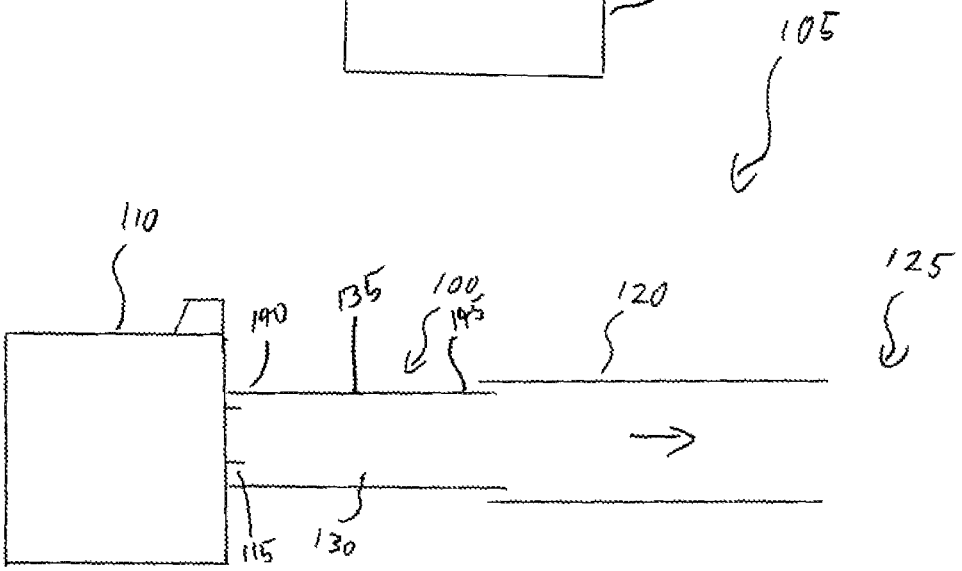
FIG. 1B

CLOTHES DRYER FIRE EXTINGUISHER SYSTEM

FIELD OF THE INVENTION

The present invention relates to a fire extinguishing system generally, and more specifically, to a fire extinguishing system comprising a conduit, at least one storage, and at least one valve connected to the at least one storage wherein the valve is responsive to a heat event within the conduit.

BACKGROUND

Various studies have shown substantial damages caused by clothes dryer fires. As an example, the U.S. Consumer Product Safety Commission estimated that 15,500 clothes dryer fires in the United States alone result in 10 deaths, 310 injuries, and $84.4 million in damages annually. Despite advancements in safety, there continues to be a substantial need for improved safety mechanisms for home appliance exhausts, such as those on clothes dryers.

A large number of clothes dryer fires ignite in or immediately progress to lint vent exhaust systems where lint removed from clothing, as well as other debris, may act as kindling and expand the size and potential for damage of a fire.

SUMMARY

In accordance with one embodiment, there is provided a fire extinguisher system comprising a conduit, which may be a portion of a lint vent exhaust tube for a clothes dryer, at least one storage, and at least one valve connected to the at least one storage responsive to a heat event within the conduit.

BRIEF DESCRIPTION OF THE DRAWINGS

FIGS. 1A and 1B show one embodiment of an aspect of a fire extinguisher system in accordance with the current disclosure implemented in a clothes dryer with a lint vent exhaust system;

DETAILED DESCRIPTION OF THE PREFERRED EMBODIMENTS

Figure 2:
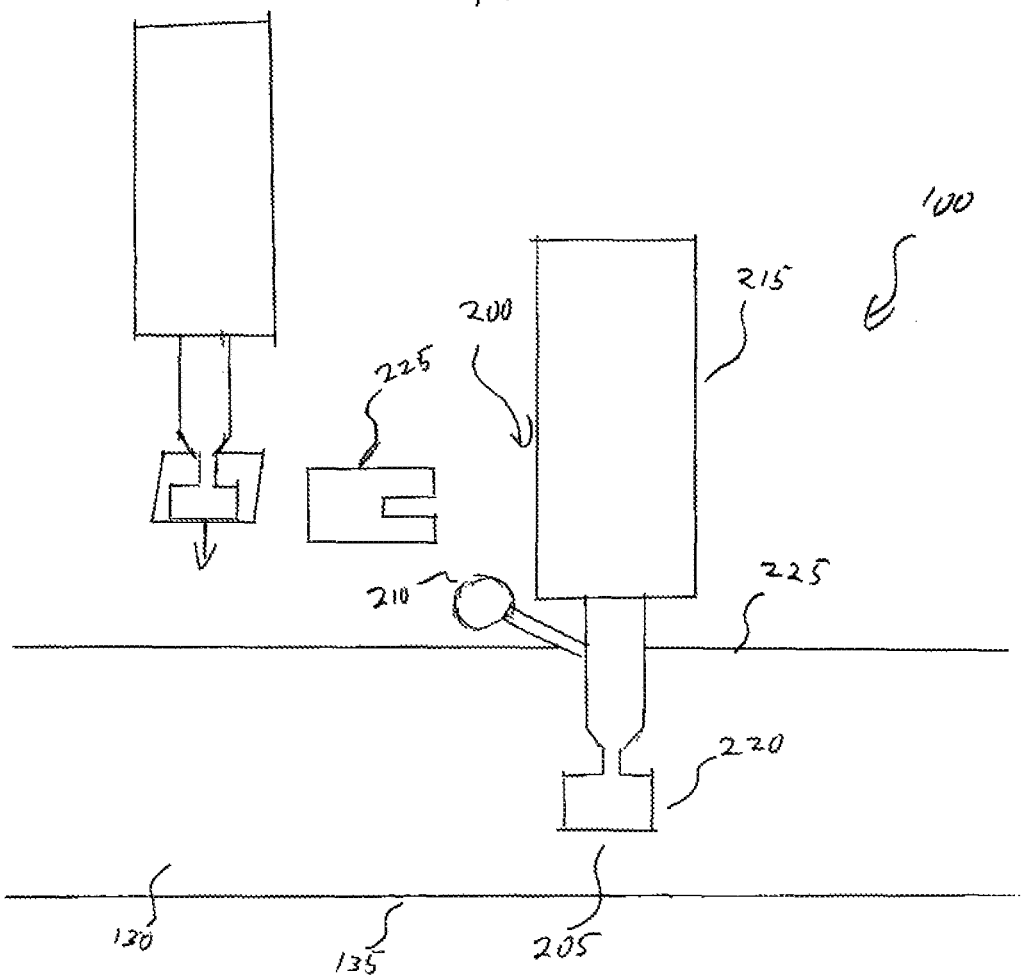
FIG. 2 is one embodiment of a fire extinguisher system in accordance with the current disclosure.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such.

Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

It is important to note that the embodiments disclosed by the invention are only examples of the many advantageous uses of the innovative teachings herein. In general, statements made in the specification of the present application do not necessarily limit any of the various claimed inventions. Moreover, some statements may apply to some inventive features but not to others. In general, unless otherwise indicated, singular elements may be in plural and vice versa with no loss of generality.

FIGS. 1A and 1B illustrate an embodiment of a fire extinguisher system 100 in accordance with the invention integrated into a clothes dryer lint exhaust system 105. FIG. 1A shows a rear surface of a clothes dryer 110 as shown more completely in FIG. 1B. The rear surface of dryer 110 contains a lint vent exhaust port 115. In the dryer shown, a dryer lint vent exhaust tube 120 is coupled to port 115 through fire extinguisher system 100. As shown in FIG. 1B, exhaust tube 120 extends away from dryer 110 and vents to an outside area 125.

When fire extinguisher system 100 is implemented into dryer 110, fire extinguisher system 100 comprises a housing that functions as a conduit 130 extending from port 115 to exhaust tube 120, with arrows in FIG. 1B indicating direction of air flow exiting the dryer 110 through conduit 130. While the conduit 130 is preferably cylindrical to mate with a typically cylindrical exhaust port 115, it will be appreciated that the conduit 130 can be any size, shape, cross-section, thickness and material, as long it is capable of mating with the exhaust port 115 and the exhaust tube 120. In one embodiment where fire extinguisher system 100 is not implemented, port 115 connects directly to tube 120 (not shown). In a preferred embodiment, a periphery 135 or a peripheral outer surface of the conduit 130 is defined by and between a first end 140 and a second end 145 that are each preferably connected to the exhaust port 115 and the exhaust tube 120 respectively using a press fit connection. It will be appreciated that different types of connections may be used as well, including threaded screw type connections, latches, clips, tube clamps, and others.

As will be described in more detail below, when conditions indicating a fire are experienced in conduit 130, which might occur for example if lint or other debris (not shown) is caused to ignite upon exit from the exhaust tube 115, a fire/heat release valve (described below) connected to a storage of fire suppression material (described below) is actuated in response to the conditions indicating a fire. The suppression material is then introduced into the conduit 130 within periphery 135 to extinguish any fire or excessive heat condition present within the conduit 130 and adjacent surroundings.

In some embodiments, rather than being implemented between exhaust port 115 and exhaust tube 120, fire extinguisher system 100 may replace a segment of the dryer lint vent exhaust tube 120. In such a way, it may be more directly integrated into a dryer 110 during manufacturing or installation. Alternatively, fire extinguisher system 100 may be connected directly to existing features, such as exhaust port 115 and exhaust tube 120 to ease retrofitting. By replacing a segment of tube 120, a user may avoid potential problems due to an exhaust tube with an improper length, such as a kinked tube, and associated increased risks, such as flammable materials becoming caught within kinked tubes.

FIG. 2 illustrates an embodiment of fire extinguisher system 100 in accordance with the current disclosure generally defined by conduit 130 with periphery 135 and at least one fire extinguisher 200. Fire extinguisher 200 further comprises a nozzle 205, a pressure gauge 210, a chemical storage reservoir 215, and a fire/heat release valve 220. It will be appreciated that although fire extinguisher 200 is a chemical fire extinguisher shown with a chemical storage reservoir 215, other types of fire extinguishers may be used as well, and may comprise, for example, water based fire extinguishers and non-chemical fire extinguishers among other possibilities, with appropriate storage, actuation, and monitoring mechanisms.

Fire extinguisher 200 is arranged so as to act within the interior of the periphery 135 of the conduit 130, with the periphery 135 supporting the fire extinguisher 200 in the present embodiment. In a preferred embodiment, a portion of fire extinguisher 200 extends within and through the periphery 135 so that it extends into conduit 130, while the majority of fire extinguisher 200 remains external of the conduit 130. Fire extinguisher 200 may be supported by an interface 225 between fire extinguisher 200 and periphery 135. Various types of connections are contemplated for supporting fire extinguisher 200. In a preferred embodiment, fire extinguisher 200 is slidably connected to or associated with the periphery 135 through an opening shaped to accommodate the fire extinguisher 200. In such a case, the fire extinguisher 200 may be supported by a cradle at interface 225. It will be appreciated that different types of connections may be used as well, including threaded screw type connections, latches, clips, and others.

In the embodiment of FIG. 2, the reservoir 215 and pressure gauge 210 are external of the periphery 135 and conduit 130, and can be easily monitored, maintained, and potentially replaced without exposing the interior of the conduit 130. Fire/heat release valve 220 is actuated within the interior of the conduit 130 to dispense fire suppression material stored within the reservoir 215 to extinguish any fire or excessive heat condition present within the conduit 130 and adjacent surroundings.

FIG. 3 illustrates an alternative embodiment of a fire extinguisher system 300 in which at least one fire extinguisher 400, and preferably a plurality of fire extinguishers 400 are disposed within the interior of the periphery 135 of the conduit 130. In a preferred embodiment, periphery 135 includes at least one mount 305 for supporting a fire extinguisher 400. In one embodiment, the mount 305 may be a sleeve 310 and fire extinguisher 400 may be inserted into sleeve 310. In an alternative embodiment, a mount may be an opening or a loop (not shown) for receiving a clip 315 affixed to a fire extinguisher 400.

In a preferred embodiment, fire extinguisher 400 may be introduced into the conduit 130 and/or accessed through the periphery 135 by way of a hatch or window (not shown) in the outer surface of periphery 135. Alternatively, the outer surface of the periphery 135 may not be provided with a through access and the fire extinguisher 400 may be accessible from the first end 140 and/or the second end 145 of the periphery 135.

Figure 3A:
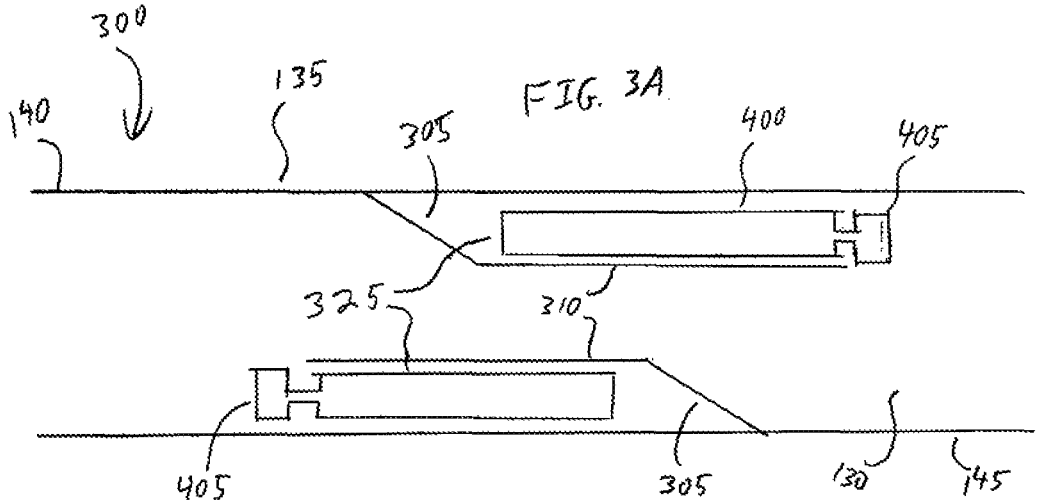
FIGS. 3A and 3B illustrate a second embodiment of a fire extinguisher system in accordance with the current disclosure.
Figure 3B:
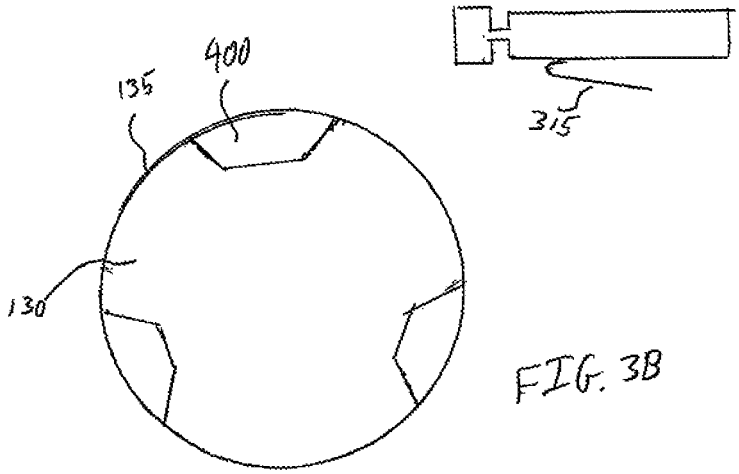

In a preferred embodiment, fire extinguisher system 300 may comprise a plurality of fire extinguishers 400. In such a case, fire extinguishers 400 may be mounted at regular intervals around the inner circumference of the conduit 130. As one example, two fire extinguishers 400 may be mounted at 180 degree intervals around the interior of the periphery 135 as shown in FIG. 3A. Similarly, three fire extinguishers 400 may be mounted at 120 degree intervals as shown in FIG. 3B. While two or three extinguishers 400 are shown in FIGS. 3A and 3B, it will be appreciated that other numbers of extinguishers in different locations and orientations may be operable. In embodiments containing a plurality of fire extinguishers 400, the extinguishers 400 may be directed in opposing directions 325, in order to better distribute a fire suppressing substance through nozzles 405.

While the illustrated embodiments show fire extinguisher 400 either entirely within periphery 135 as in FIGS. 3A and 3B or fire extinguisher 200 partially within periphery 135, as in FIG. 2, it will be appreciated that a fire extinguisher may remain entirely outside periphery 135 and be arranged so as to act through a hatch or window in the surface of the periphery 135 (not shown).

Figure 4:
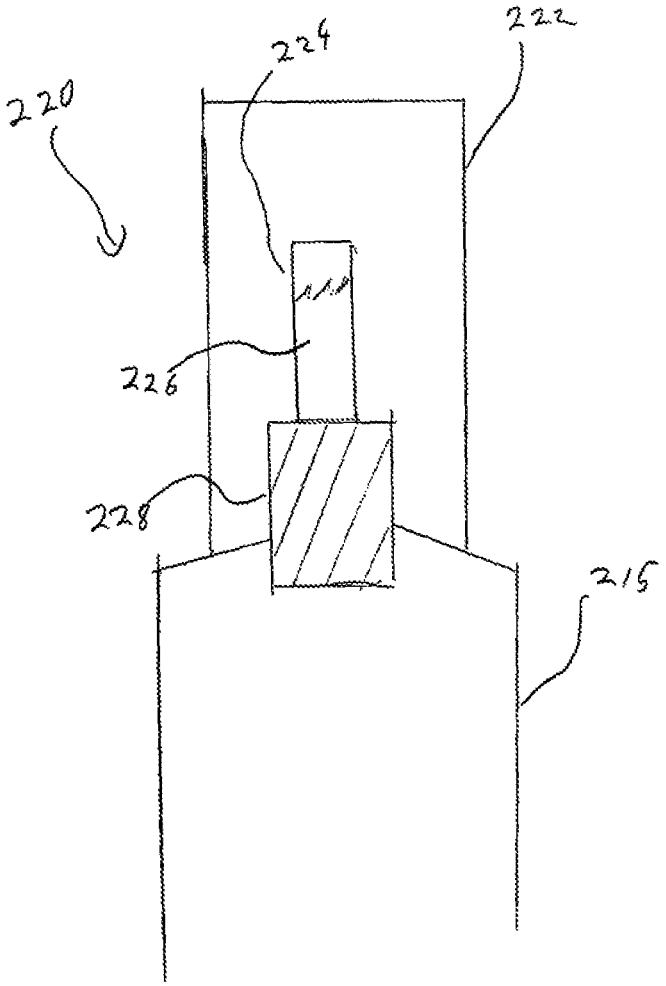
FIG. 4 is a fire/heat release valve for use with a fire extinguisher system in accordance with the current disclosure.

FIG. 4 illustrates one embodiment of a fire/heat release valve 220 that can be used with fire extinguisher system 100 of FIGS. 1A-2, or with other embodiments described herein. A preferred embodiment comprises a bracket 222 for holding a fragile receptacle 224, that retains a fluid 226. Receptacle 224 is positioned to hold a plug 228 in place maintaining pressure to prevent the release of a fire suppressing substance contained in reservoir 215. Fluid 226 expands when exposed to heat, applying pressure to receptacle 224. At a high temperature, pressure applied to receptacle 224 by fluid 226 breaks receptacle 224, releasing plug 228 from reservoir 215 and enabling the fire suppressing substance contained in the reservoir 215 to flow through the fire/heat release valve 220 and suppress the fire or heat condition. It will be appreciated that other actuation mechanisms may be implemented as well, either in the form of an alternate valve 220 or alternative structures more generally.

The various embodiments of fire extinguisher systems described provide a user with fire suppression features, increasing safety in the use of appliances, specifically clothes dryers. In particular, fire extinguisher system protects against fire caused by various appliances having exhaust systems, including clothes dryer lint vent exhaust systems as well as oven and stove exhaust systems, heating and air conditioning systems, water boilers, and fire place chimneys. Further, fire extinguisher system may be implemented in both a home environment and in a commercial or industrial environment, such as in a Laundromat or by a bulk laundry service using industrial sized dryers. Fire extinguisher system 100 may similarly be implemented in, for example, commercial kitchens for appliances having commercial exhaust systems.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

All examples and conditional language recited herein are intended for pedagogical purposes to aid the reader in understanding the principles of the invention and the concepts contributed by the inventor to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof Additionally, it is intended that such equivalents include both currently known equivalents as well as equivalents developed in the future, i.e., any elements developed that perform the same function, regardless of structure.

What is claimed is:

1. A fire extinguisher system comprising:

a conduit;

at least one storage for storing fire suppression material; and at least one valve connected to the at least one storage that is responsive to a heat event within the conduit for delivering fire suppression material from the at least one storage;

wherein the at least one valve is fluid based and situated within an interior of the conduit and comprises at least one sealed receptacle containing a fluid, and wherein the fluid expands in the heat event to break the receptacle and actuate the valve to deliver the fire suppression material, and wherein a periphery of the conduit has a first end in connection with an exhaust port of an appliance.

2. The fire extinguisher system of claim 1 wherein the conduit is a segment of an exhaust system.

3. The fire extinguisher system of claim 1 wherein the conduit is between the exhaust port and an exhaust tube.

4. The fire extinguisher system of claim 1 wherein the at least one storage contains chemical foam or water.

5. The fire extinguisher system of claim 1 wherein the heat event within the conduit is detected by a sensor.

6. The fire extinguisher system of claim 1 wherein the valve comprises:

a plug sealing the at least one storage;

wherein the at least one receptacle maintains pressure against the plug and wherein the pressure is released when the receptacle breakes in the heat event.

7. The fire extinguisher system of claim 1 wherein the at least one storage is located inside a periphery of the conduit.

8. The fire extinguisher system of claim 7 wherein the periphery contains at least one mount, sleeve, clip, or fixture for mating with a clip for at least one storage.

9. The fire extinguisher system of claim 1 wherein a part of the at least one storage is located outside of a periphery of the conduit.

10. The fire extinguisher system of claim 9 wherein the storage is slidably removable from the periphery.

11. The fire extinguisher system of claim 10 wherein the periphery contains at least one mount, sleeve, clip, or fixture for mating with a clip for at least one storage.

12. The fire extinguisher system of claim 1 wherein the at least one valve acts within a periphery of the conduit.

13. The fire extinguisher system of claim 12 further comprising a plurality of storages wherein each of the plurality of storages has an associated valve.

14. The fire extinguisher system of claim 13 wherein the valves face a plurality of directions.

15. The fire extinguisher system of claim 1 wherein the at least one storage is oriented parallel to a longitudinal axis of the conduit.

16. A fire extinguisher system comprising:

an appliance;

an exhaust;

at least one storage for storing fire suppression material; and at least one valve connected to the at least one storage, to a heat event within a conduit, for delivering fire suppression material from the at least one storage;

wherein the at least one valve is fluid based and situated within an interior of the conduit and comprises at least one sealed receptacle containing a fluid, and wherein the fluid expands in a heat event to break the receptacle and actuate the valve to deliver the fire suppression material, and wherein a periphery of the conduit has a first end in connection with an exhaust port of an appliance.

17. The fire extinguisher system of claim 16 wherein the at least one storage is between the appliance and the exhaust tube.

18. The fire extinguisher system of claim 17 wherein the at least one storage is supported by a periphery surrounding the conduit between the appliance and the exhaust and the at least one valve is responsive to the heat event within the conduit.

* * * * *